United States Patent [19]

Csapo

[11] 4,218,213

[45] Aug. 19, 1980

[54] THERMALLY CONDUCTIVE PARTITION

[75] Inventor: Michael A. Csapo, Wyncote, Pa.

[73] Assignee: Selas Corporation of America, Dresher, Pa.

[21] Appl. No.: 951,389

[22] Filed: Oct. 16, 1978

[51] Int. Cl.[2] ..... F27D 23/00

[52] U.S. Cl. ..... 432/249; 432/185

[58] Field of Search ..... 432/26, 29, 31, 155, 432/167–169, 171, 185, 188, 192, 197, 198, 202, 206, 217, 226, 247, 249, 251; 52/395, 467

[56] References Cited

U.S. PATENT DOCUMENTS

| | | | |
|---|---|---|---|
| 480,230 | 8/1892 | Bonta | 432/249 |
| 1,448,162 | 3/1923 | Sneddon | 432/251 |
| 1,472,401 | 10/1923 | Roberts | 432/197 |
| 1,793,129 | 2/1931 | Patton | 432/247 |
| 2,129,057 | 9/1938 | Greene | 432/249 |
| 2,662,263 | 12/1953 | Fuger | 432/185 |
| 2,713,480 | 7/1955 | Ruckstahl | 432/128 |
| 2,853,440 | 9/1958 | Hughes | 432/249 |
| 3,448,552 | 6/1969 | Schmitt et al. | 52/395 |
| 3,940,244 | 2/1976 | Sauder et al. | 432/247 |
| 4,067,155 | 1/1978 | Ruff et al. | 52/395 |

*Primary Examiner*—Henry C. Yuen

*Attorney, Agent, or Firm*—Miller & Prestia

[57] ABSTRACT

A partition of high thermal conductivity is provided to separate a furnace heating zone from a furnace reaction zone, the reaction zone being at least partially heated by radiant heat from the heating zone. In a preferred embodiment, the partition means comprises a plurality of individual panels which are arranged in horizontally extending rows across the furnace. A ceramic seal plate is secured over the longitudinal interface between the adjacent panels in the same horizontal row. The seal plates in one horizontal row which extend across the width of the furnace are slightly offset from the seal plates in adjacent rows to compensate for thermal expansion forces which may tend to move the panels and sealed expansion spaces are provided between adjacent panels in the width-wise and longitudinal direction.

4 Claims, 6 Drawing Figures

FLUID

FIG. 2.
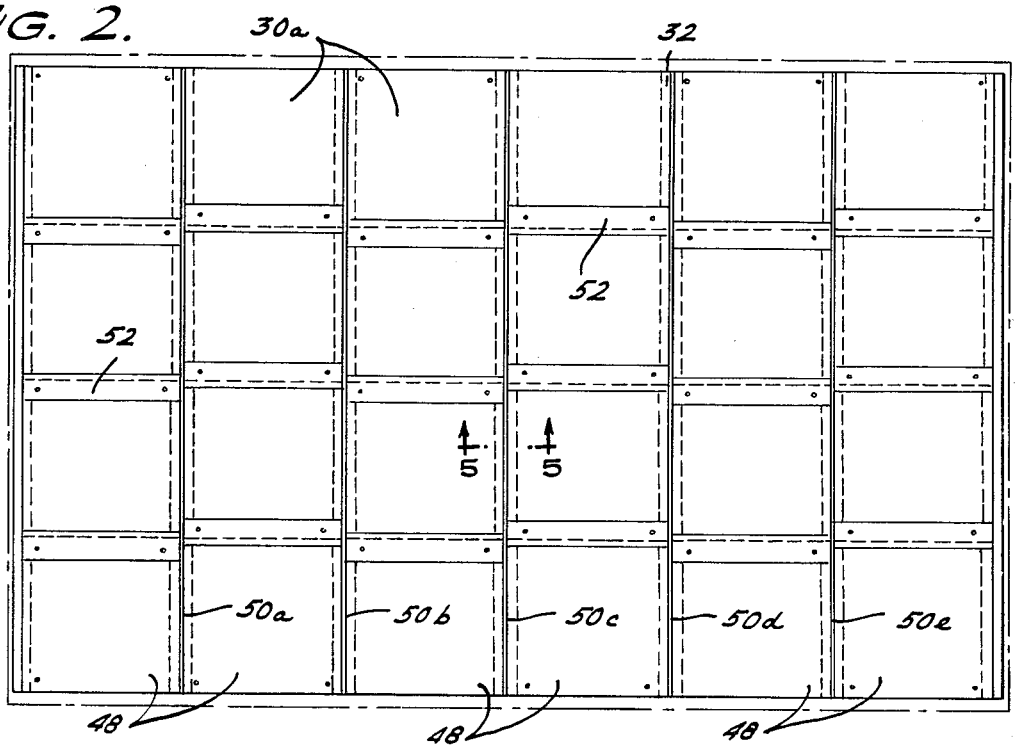
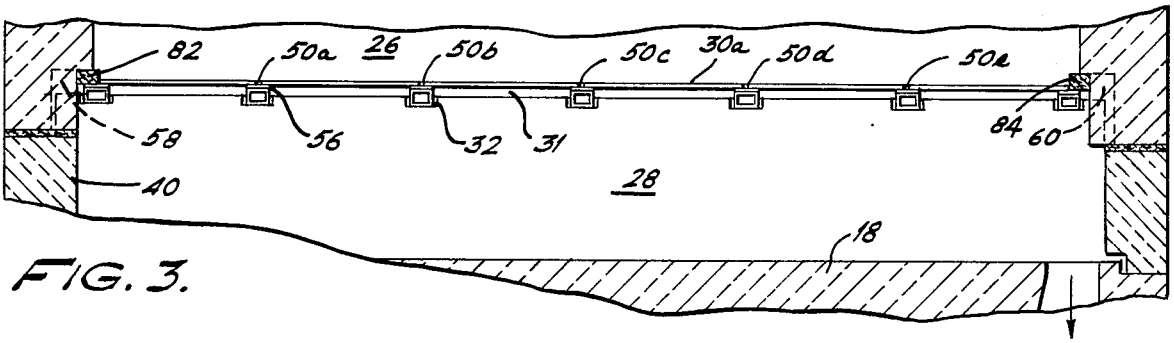
FIG. 3.
FIG. 4.
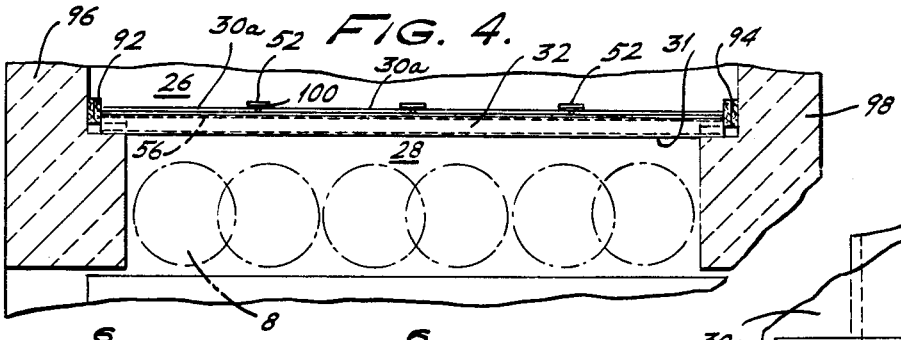
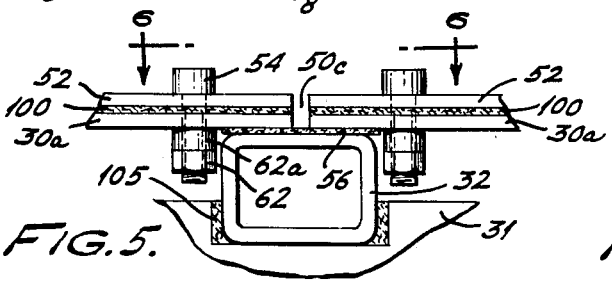
FIG. 5.
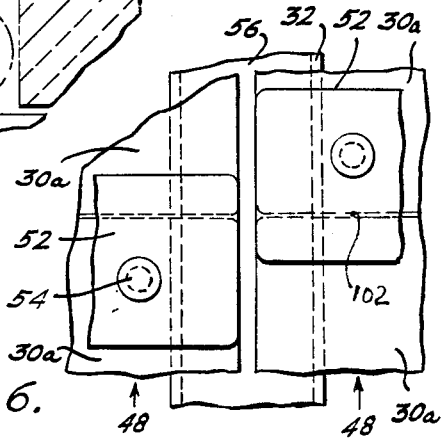
FIG. 6.

THERMALLY CONDUCTIVE PARTITION

BACKGROUND OF THE INVENTION

This invention pertains to a partition for separating zones in furnaces of the type wherein one zone is at least partially heated by radiant heat emanating from another zone. In some furnaces it is desirable to provide a substantially gas impervious separation between zones so that the sweep gas, for example, may be kept separate from combustion gases from burners located in another zone.

In fossil fuel burning furnaces, separation between heating and reaction zones is also desirable to eliminate product contamination by direct contact with combustion products.

This invention is also applicable to electrically heated furnaces. For example, the provision of a means for providing substantially gas impervious separation may serve to prevent possible detrimental reaction between sweep gases or outgases with electric heating elements.

Further, in many electric and fuel fired heating zones, it is necessary to provide a partition means of high thermal conductivity so that the requisite reaction temperatures can be obtained in the reaction zone.

Additionally, it is highly desirable to provide a partitioning structure of high heat strength wherein the bending load exerted thereon is substantially equally distributed throughout the structure so that the high temperature existing in the heating zone will not cause cracking or degradation of the partition.

These and other objects are attained by the novel partition structure herein disclosed, which will be further explained in conjunction with the appended drawings.

BRIEF DESCRIPTION OF THE DRAWINGS

FIG. 2 is a top view of the partitioning means shown in FIG. 1;

FIG. 3 is a longitudinal sectional view of a furnace and partitioning means in accordance with the invention, with details as to the screw conveyor being omitted for increased clarity;

FIG. 4 is a transverse cross sectional view of the furnace assembly shown in FIG. 3 with the screw conveyors being shown diagrammatically for increased clarity;

FIG. 5 is a sectional view of the partitioning means shown in FIG. 2, taken along the lines and arrows 5—5 shown in FIG. 2;

FIG. 6 is a sectional view of the partitioning means shown in FIG. 5, taken along the lines and arrows 6—6 of FIG. 5.

DETAILED DESCRIPTION OF THE INVENTION

Figure 1:
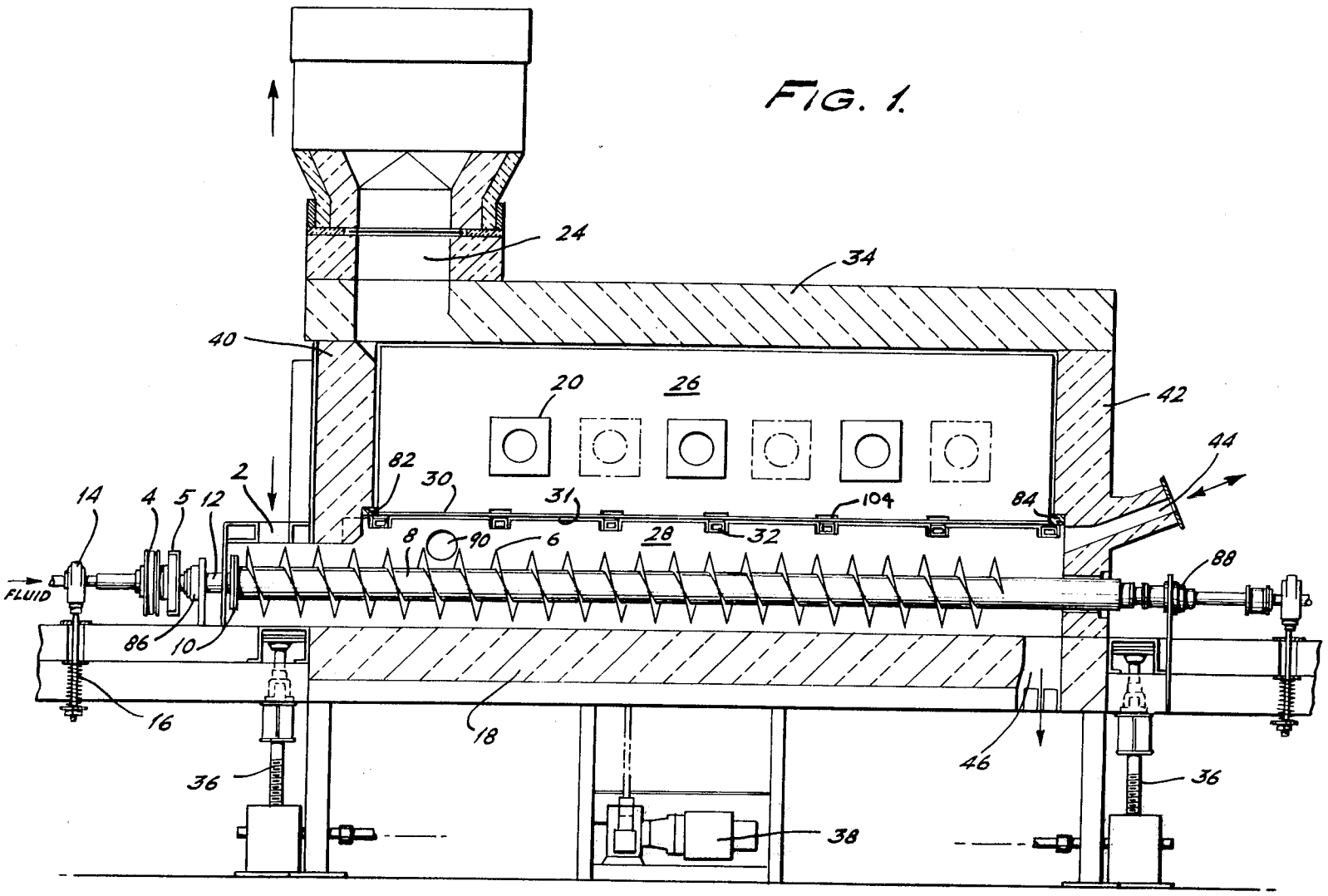
FIG. 1 is a longitudinal sectional view of a furnace including a partitioning means in accordance with the invention.

Specific terms will be used hereinafter in the detailed description for the purposes of describing the invention. However, the use of such specific terms should in no way limit the scope of the invention, which scope is defined in the appended claims.

With reference to FIG. 1 of the drawings, there is shown in longitudinal view, a furnace in accordance with the invention. The furnace comprises feed port 2 into which the material to be heat treated is admitted to the furnace. The furnace is partitioned into heating chamber 26 and reaction chamber 28 by means of muffle 30. Transversely arranged beams 32 and longitudinally extending beams 31 secure the muffle 30 in the furnace. Beams 31 are keyed into furnace sidewalls 40, 42 and the transverse beams 32 are mounted within notches in the beams 31 and span the furnace in the width-wise direction. The transverse beams 32 are anchored in grooves 104 which are spaced apart from one another on the longitudinal sidewalls of the furnace. Ceramic seals 82, 84 are provided along the wall zone.

As shown, heating zone 26 is heated by means of a plurality of fuel burners 20, which burners may be adapted for either oil or gaseous fuel consumption. Flue 24 extending through roof 34 of the furnace provides escape for the waste gases emanating from the burners 20. Reaction zone 28 is at least partially heated by radiation from the heating zone 26. In this respect, it is important that the muffle 30, which separates the heating and reaction zones, be composed of highly thermally conductive material and that it be very strong at high temperature.

Shaft 8 of the screw conveyor having screw flights 6 is coupled to inner support shaft 12 by flange 10. Drive pulley 4 and its associated drive belt are provided to impart rotation to the shaft 12 and screw flight shaft 8. Although FIG. 1 shows only one such shaft 6, 8, a plurality may be used and a gear 5 is provided to drive an adjacent screw of the group. The screw conveyor and its relationship with the furnace are the subject of my co-pending application Ser. No. 951,384, filed Oct. 16, 1978.

Adjacent to the respective ends of the inner shaft 12 are provided outboard bearings 14 which are urged, each by means of a spring 16, in a downward direction. These outboard bearings 16 cooperate with novel bearing plugs (shown and explained in the aforementioned co-pending application) and with the fixed inboard bearings 86, 88 to distribute the bending load on both the inner and outer shaft in such a manner that relatively low stress is exerted on the regions within the reaction chamber 28. This is highly advantageous in light of the fact that the furnace is to be ideally operated at temperatures in excess of 2,000° F. wherein excessive stress on the shafts could lead to serious degradation thereof.

Hearth 18 is mounted on screw jacks 36 or like means which are reciprocated by motor 38 and associated linkage members. In this manner, the hearth 18 may be lowered for cleaning purposes and then raised for operation.

Exit port 46 is provided along the hearth 18 for discharge of the heat treated material after it has been transported through the furnace by the screw flights 6. Exit gas port 44 is provided for discharge of the reaction gases. Port 90 is provided in one of the longitudinal sidewalls of the furnace and may be used for introduction of sweep air. Of course, the positioning of the ports 44, 90 may be reversed in practice.

Usually, multiple pairs of screw assemblies (see FIG. 4) are provided in the furnace chamber 28. Preferably, the flight pitch of one screw in a pair is opposite from that of the other screw in the pair and the screw flights of each screw intermesh with those of the other screw in the pair so that the desired material to be heat treated is advanced through the furnace when the screws in the pair are rotated in opposite directions.

At the left-hand side of FIG. 1, there is shown a cooling fluid entry means by which cooling fluid is pumped through the inner shaft 12. Preferably, cool air is pumped through the inner shaft 12.

Turning now to FIG. 2, the partitioning muffle 30 of this invention comprises a plurality of individual panel members 30*a*. These panels 30*a* are composed of a high thermally conductive material, preferably silicon carbide, which has a thermal conductivity of, for example, at least approximately 150 BTU/in/hr ft$^2$ when the furnace is operated at 2,000° F. The panel members 30*a* are disposed in adjacent width-wise extending rows 48 and are supported by horizontal beams 32 which are also preferably composed of the same silicon carbide material having high strength at high temperature. Expansion spaces 50*a, b, c, d* and *e* are provided between the adjacent width-wise rows 48 so as to allow for a certain degree of expansion of the members 30*a* caused by the high temperature condition in the combustion zone 26.

Seal plates 52 cover the longitudinally extending interfaces between adjacent panel members 30*a* in the same row 48. Preferably, adjacent panels 30*a* are spaced from each other by a fraction of an inch at this longitudinal interface. The seal plates in one width-wise row 48 are slightly offset from the cover plates in an adjacent width-wise row 48 so as to inhibit longitudinal shifting of the panels 30*a* which otherwise may occur due to the high temperatures existing in the heating zone 26. Ceramic bolts 54 secure the panels 30*a* to the seal plates 52. As shown, certain of the end-wise panels in the horizontal rows 48 are secured to a ledge or the like which is disposed along the width-wise walls of the furnace.

Turning now to FIG. 3, transverse beams 32 are supported by longitudinal beams 31 which are keyed into the furnace walls 40, 42 as shown at 58, 60. A fibrous ceramic blanket 56 (see also FIG. 5) extends along the lengths of the transverse beams 32 to act as a seal underneath the expansion spaces 50*a, b, c, d* and *e* (see also FIG. 5). Ceramic seals 82, 84 are formed adjacent end walls 40, 42. Preferably, ceramic fiber packing 105 (FIG. 5) is inserted in the grooves of the longitudinal beams 31 into which the transverse beams 32 are received (see FIG. 5).

With reference now to FIG. 4, three pairs of intermeshing screws 8 are shown, for example. They extend longitudinally through the furnace reaction zone 28. Longitudinal ceramic gaskets 92, 94 are provided along longitudinally extending sidewalls 96, 98 to provide a seal between the heating zone 26 and the reaction zone 28. Underlying the seal plates 52 are longitudinally extending ceramic fiber blankets 100 which seal the longitudinally extending interfaces between adjacent panels 30.

In FIG. 5, which is an enlarged sectional view, fiber blanket 56, which extends along beam 32, is shown as sealing the partitioning structure along expansion space 50*c*, which is formed along two of the horizontally extending rows of panels 30*a*. Seal plates 52 are secured to panels 30*a* by the provision of ceramic bolts 54, ceramic sleeve 62*a* and ceramic nut 62. Ceramic blanket 100 is sandwiched between the seal plate 52 and panel 30*a* to insure sealing along the longitudinally extending interface between adjacent panels disposed along the same horizontal row. During installation, the ceramic bolts 54 are hand tightened only so that the bolts 54 will be able to expand and contract somewhat in the high temperature condition existing within the furnace without cracking either the seal plates 52 or panels 30*a*.

With reference to FIG. 6, the seal plates 52 in adjacent rows are slightly offset from their neighboring seal plates 52. This decreases the tendency of certain panels to shift or rack into the next adjacent row. The longitudinal clearance 102 between adjacent panels 30*a* in the same row 48 is preferably only a fraction of an inch.

It will be appreciated that in order to radiate heat from the heating zone to the reaction zone, it is necessary that the panels 30*a* be constructed of a highly thermally conductive material. In this respect, it is desirable that the conductivity of the plates be on the order of about 150 BTU/in/hr ft$^2$ or more when the furnace is operated at 2,000° F. At the same time, the thermal expansion and contraction of the structure should be relatively low so as not to build excessive stress on the structure which would otherwise tend to crack or degrade the partition. Thermal expansion on the order of about $2.7\times10^{-6}$ IN/IN °F. at 2,000° F. is desirable for all of the members 30(*a*), 31 and 32.

Further, by the provision of a partition which comprises a plurality of individual panel members, the stress factors are generally equalized from one portion of the panel to another panel portion as opposed to a partition comprising a single sheet material wherein different portions of the same sheet may bear different thermal stress loads and wherein "hot" and "cold" spots may exist at various locations along the sheet and cause cracking thereof.

For these reasons, it is highly desirable that the panels, horizontal beams, and seal plates alike be composed of a silicon carbide material which is able to attain the desired high thermal conductivity and low thermal expansion properties, combined with high strength at high temperatures.

Those skilled in the art will be able to fashion equivalent members and means as substitutions for the various structural members herein disclosed. For instance, those skilled in the art will be able to devise equivalent sealing structures to provide sealing between the heating and reaction zones. Further, other materials may be utilized in accordance with the invention as long as these materials contribute the required thermal conductivity and thermal expansion properties to the partition while at the same time providing particularly high strength at temperatures of about 2,000° F. and above. All such equivalent means and members are intended to be covered by the appended claims.

I claim:

1. In a heat treatment furnace having a heating zone and a reaction zone which is at least partially heated by radiant heat from the heating zone, the improvement comprising thermally conductive partition means including a plurality of individual muffle panels for separating the reaction and heating zones, said muffle panels being disposed in a plurality of adjacent rows and wherein first expansion spaces are located between said adjacent rows and second expansion spaces are provided between neighboring panels of the same row, said second expansion spaces being generally perpendicularly related to said first expansion spaces, and a plurality of seal plates, each seal plate being superposed over one of said second expansion plates.

2. Furnace as defined in claim 1, further comprising fibrous insulation overlying said second expansion spaces and being disposed underneath said seal plate.

3. Furnace as defined in claim 1, further comprising ceramic bolts and ceramic nuts connecting one of said seal plates and one of said individual muffle panels.

4. Furnace as defined in claim 1, wherein the seal plates disposed in a row of individual muffle panel members are slightly offset with respect to the seal plates disposed in a row of panels adjacent thereto.

* * * * *